US008931863B2

(12) United States Patent
Vulava

(10) Patent No.: US 8,931,863 B2
(45) **Date of Patent: *Jan. 13, 2015**

(54) CONSUMER APPLIANCE DRAWER WITH IMPROVED ANTI-RACKING SYSTEM

(75) Inventor: Gopi Krishna Chowdary Vulava, Okemos, MI (US)

(73) Assignee: General Electric Company, Schenectady, NY (US)

( * ) Notice: Subject to any disclaimer, the term of this patent is extended or adjusted under 35 U.S.C. 154(b) by 209 days.

This patent is subject to a terminal disclaimer.

(21) Appl. No.: 13/088,637

(22) Filed: Apr. 18, 2011

(65) Prior Publication Data

US 2012/0262044 A1 Oct. 18, 2012

(51) Int. Cl.

| | |
|---|---|
| ***A47B 96/04*** | (2006.01) |
| ***F24C 15/16*** | (2006.01) |
| ***F25D 23/02*** | (2006.01) |
| ***F25D 25/02*** | (2006.01) |

(52) U.S. Cl.

CPC ..... *F24C 15/162* (2013.01); *F25D 23/021* (2013.01); *F25D 25/025* (2013.01); *A47B 2210/175* (2013.01)

USPC ..... 312/402

(58) Field of Classification Search

USPC ..... 312/402, 404, 334.14, 334.15, 334.9, 312/334.11, 334.13, 334.7, 334.6, 334.27, 312/334.32, 334.33, 334.5, 331

See application file for complete search history.

(56) References Cited

U.S. PATENT DOCUMENTS

| | | | | |
|---|---|---|---|---|
| 2,199,260 | A * | 4/1940 | Hultberg | 312/334.5 |
| 2,300,287 | A * | 10/1942 | Huarisa | 369/12 |
| 2,468,990 | A * | 5/1949 | Lundstrom | 312/334.33 |
| 2,587,691 | A * | 3/1952 | Brewer | 312/334.41 |
| 4,285,560 | A * | 8/1981 | Miller | 312/331 |
| 4,324,439 | A | 4/1982 | Hagen et al. | |
| 4,529,190 | A * | 7/1985 | Goodwin et al. | 271/213 |
| 5,040,856 | A | 8/1991 | Wilkins et al. | |
| 5,322,365 | A * | 6/1994 | Teufel et al. | 312/330.1 |
| 5,366,284 | A | 11/1994 | Baker et al. | |
| 5,944,400 | A | 8/1999 | Fulterer | |
| 6,039,423 | A | 3/2000 | Fulterer | |
| 6,386,659 | B1 * | 5/2002 | Muller et al. | 312/334.38 |
| 6,412,892 | B1 | 7/2002 | Bonat | |
| 6,499,818 | B2 | 12/2002 | Brüstle | |
| 6,682,159 | B2 | 1/2004 | Compagnucci | |
| 7,306,301 | B2 | 12/2007 | Walburn | |

(Continued)

FOREIGN PATENT DOCUMENTS

GB 1235094 A * 6/1971 ..... F25D 25/02

*Primary Examiner* — Darnell Jayne
*Assistant Examiner* — Kimberley S Wright
(74) *Attorney, Agent, or Firm* — Dority & Manning, P.A.

(57) ABSTRACT

A consumer appliance, such as a refrigerator, includes a compartment having opposite sides and a bottom wall. A pull-out drawer is configured above the bottom wall of the compartment. A slide assembly is configured on each opposite side of the compartment and includes a base mounted to the compartment and a slide member linearly moveable along the base. The pull-out drawer has a slide bracket mounted to each respective slide member for movement of the drawer into and out of the compartment. A bottom slide assembly has a slide member and a base mounted on the bottom wall of the compartment. A cross bar is connected to and spans between the slide brackets below the pull-out drawer and is connected to the slide member of the bottom slide assembly.

17 Claims, 4 Drawing Sheets

(56) References Cited

U.S. PATENT DOCUMENTS

| | | | | |
|---|---|---|---|---|
| 7,527,343 | B2 * | 5/2009 | Oh et al. | 312/402 |
| 7,628,461 | B2 * | 12/2009 | Carden et al. | 312/402 |
| 7,677,125 | B2 | 3/2010 | Rotter | |
| RE41,725 | E | 9/2010 | Walburn | |
| 7,810,890 | B2 * | 10/2010 | Klein et al. | 312/334.33 |
| 2001/0035704 | A1 * | 11/2001 | Dierbeck | 312/902 |
| 2010/0019641 | A1 * | 1/2010 | Laible et al. | 312/404 |
| 2011/0018415 | A1 * | 1/2011 | Kim et al. | 312/405 |

* cited by examiner

CONSUMER APPLIANCE DRAWER WITH IMPROVED ANTI-RACKING SYSTEM

FIELD OF THE INVENTION

The present subject matter relates generally to pull-out drawers and more particularly to an anti-racking system for consumer appliance drawers.

BACKGROUND OF THE INVENTION

Various types of consumer appliances are designed with pull-out compartment drawers. For example, a number of popular refrigerator styles have a freezer compartment with one or more pull-out drawers that span the width of the appliance and include storage baskets or bins. Examples of these refrigerators include the Profile™ French door and Armoire style refrigerators from General Electric Appliances. The conventional pull-out drawers typically include side brackets that are mounted to slides of a slide mechanism that, in turn, has a base member mounted to the compartment liner.

Due to their substantial width, depth, and weight, the pull-out drawers are susceptible to misalignment between the sides when moving the drawer into and out of the appliance compartment, particularly if the door is grasped off-center and the pulling/closing force is applied non-parallel to the slide structure. This misalignment may lead to binding or "racking" of the drawer, which may make further movement of the drawer difficult and may also lead to an improper seal of the drawer in the closed position.

A known approach to minimize racking of the drawers is to synchronize the sliding movement of the opposite slide mechanisms with a gear and cross shaft assembly. A gear is provided at each side of the drawer that engages with a stationary gear rail as the drawer moves in and out of the freezer compartment. The gears are connected with a cross shaft that spans the width of the drawer. The shaft synchronizes movement of the respective gears along the gear rail, which is imparted to the slide mechanisms. Thus, any off-center pulling/pushing force on the drawer handle is compensated for through the shaft and gears.

Although the shaft and gear assembly discussed above is beneficial in minimizing the occurrence of racking, location of the shaft is problematic in that it reduces the usable volume of the compartment for features such as bins, baskets, ice buckets, and so forth, especially when such devices are suspended above or below the drawer in a freezer compartment.

Accordingly, it would be desirable to provide an anti-racking system for pull-out drawers that reduces the space occupied by the system while efficiently reducing racking of the drawer.

BRIEF DESCRIPTION OF THE INVENTION

Aspects and advantages of the invention will be set forth in part in the following description, or may be obvious from the description, or may be learned through practice of the invention.

In an exemplary embodiment, a consumer appliance, for example a refrigeration appliance, is provided with a compartment having a pull-out drawer. The appliance may be a refrigerator having a freezer compartment with one or more pull-out drawers. The pull-out drawer includes side slide assemblies with a slide bracket mounted to respective slide members configured on each opposite side of the compartment for movement of the pull-out drawer into and out of the compartment. The slide members may slide within a base member that is mounted to the opposite side walls of the compartment. A bottom slide assembly has a base mounted on the bottom wall of the compartment and a slide member movable along the base. At least one cross bar is connected directly or indirectly to (and spans between) the slide brackets below the pull-out drawer. The cross bar is also connected to the slide member of the bottom slide assembly.

In a particular embodiment, the side slide assemblies are mounted on opposite sidewalls of the compartment proximate to the bottom wall and include a flange portion that extends below the pull-out drawer. The cross bar is connected to the flange portion by any suitable device, which may allow for linear adjustability of the cross bar relative to the flange portions. The pull-out drawer may also be supported by the cross bars and bottom slide assembly, which may reduce the necessary load bearing capacity of the slide side assemblies.

It may be desirable to include a plurality of the cross bars connected to the slide brackets and the slide member of the bottom slide assembly.

In an embodiment wherein the appliance is a refrigerator, the pull-out drawer may be in a bottom freezer compartment that spans the width of the refrigerator. The drawer may include a front door panel, with the slide brackets attached at opposite sides of the front door panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
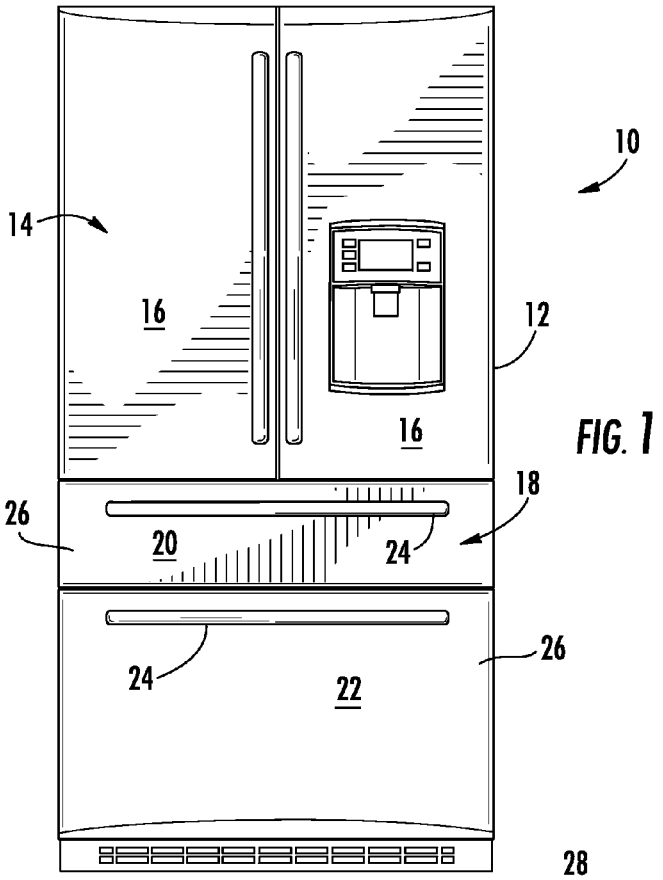
FIG. 1 is a perspective view of a consumer appliance, in particular a refrigeration appliance, that may incorporate aspects of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
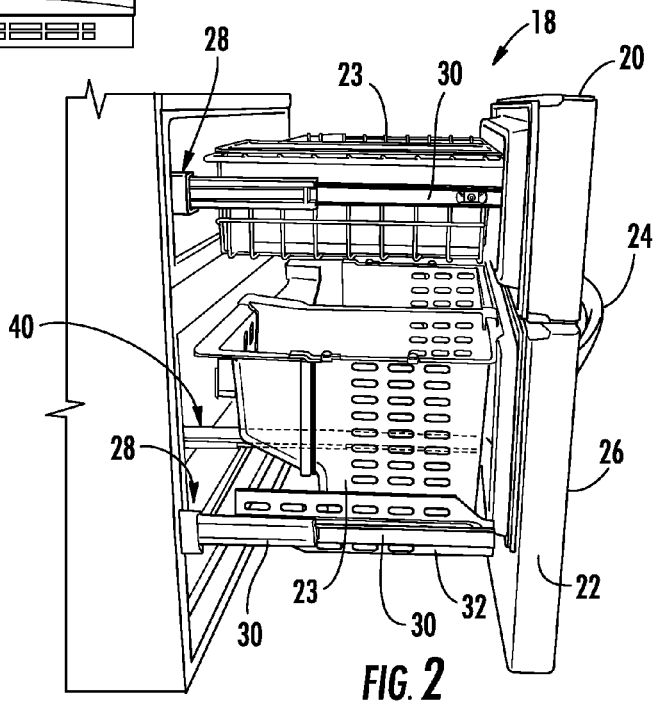
FIG. 2 is perspective view of the freezer compartment of the refrigerator of FIG. 1 with the pull-out drawers in the open position.

FIG. 1 depicts a consumer appliance 10 in a form of a refrigerator that may incorporate one or more pull-out drawers in accordance with aspects of the invention. It should be appreciated that the term "consumer appliance" is used in a generic sense herein to encompass any manner of household appliance having an internal storage compartment that is accessible via a pull-out drawer. Conventional consumer appliances include, for example, refrigerators, freezers, ovens, washing machines, dryers, ranges, and so forth. For illustrative purposes, the present invention is described herein as a refrigerator embodiment of a consumer appliance 10. In this regard, the terms "refrigerator" or "refrigeration appliance" are also used in a generic sense herein to encompass any manner of refrigeration appliance, such as a freezer, refrigerator/freezer combination, and any style or model of conventional refrigerator. In the illustrated embodiment, the refrigerator 10 is depicted as an upright refrigerator having a cabinet or casing 12 that defines a number of internal storage compartments. In particular, the refrigerator 10 includes upper fresh-food compartments 14 having doors 16 and lower freezer compartment 18 having upper drawer 20 and lower drawer 22. The drawers 20, 22 are "pull-out" drawers in that they can be manually moved into and out of the freezer compartment 18 on suitable slide mechanisms, as depicted in FIG. 2.

Although described herein with reference to pull-out freezer compartment drawers, it should be appreciated that drawers in accordance with aspects of the invention are not limited in this manner and may have utility within the fresh-food compartment 14, or in any other compartment of a consumer appliance.

F*ig*. 2 depicts the freezer compartment 18 of the refrigerator 10 with the upper drawer 20 and the lower drawer 22 pulled out of the compartment. Each drawer 20, 22 may include any manner of storage basket or bin 23. Each of the drawers 20, 22 essentially spans the width of the compartment 18 and move into and out of the compartment via a respective slide assembly 28, which are widely used and known in the art and need not be described in detail herein. In general, the slide assembly 28 includes a base 29 (FIGS. 3A and 3B) that is mounted to each opposite side of the compartment 18 (for example on the liner sidewalls 19), and one or more slide members 30 that move linearly into and out of the base 29 via a suitable bearing arrangement. Multiple slide members 30 may telescope relative to each other. The drawers 20, 22 include slide brackets 32 that are mounted to the slide members 30. The storage basket/bin 23 is fixed to the slide brackets 32.

Each drawer 20, 22 includes a handle 24 mounted to a front panel 26 whereby the drawer is moved into and out of the compartment 18 by a consumer grasping and pulling or pushing on the handle 24. As discussed above, an off-center pull/push force can result in racking of the drawer 20, 22 relative to the casing 12, particularly for the heavier lower drawer 22.

Referring to FIGS. 2 through 5 in general, the freezer compartment 18 includes side walls 19 and a bottom wall 21. A bottom slide assembly 40 is configured on the bottom wall 21. The bottom slide assembly 40 includes a slide member 42 that slides linearly relative to a base 44 mounted on the bottom wall 21. The slide assembly 40 may be any manner of conventional slide assembly commonly used for drawers, shelves, and the like. The base 44 is fixed relative to the bottom 21 by any suitable means, including adhesive compound, mechanical fasteners, and the like.

One or more cross bars 46 span between the slide brackets 32 and are connected to the slide brackets by any suitable means. In the embodiment illustrated in the figures, the cross bars 46 are mounted onto flanges 48 of the slide brackets 32. These flanges 48 may extend under the basket or bin 23, and the basket or bin may actually rest on the flange portions 48 and cross bars 46.

Figure 3A:
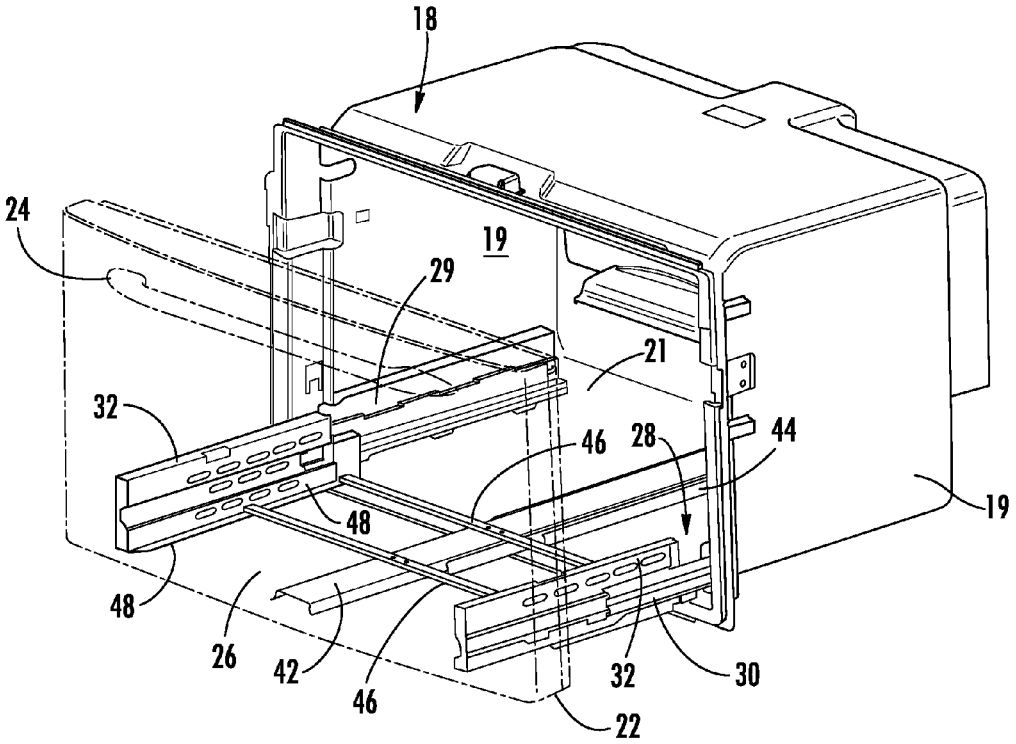
FIG. 3A is a partial perspective view of the lower pull-out drawer particularly illustrating location of the bottom slide assembly and cross bar configuration.
Figure 3B:
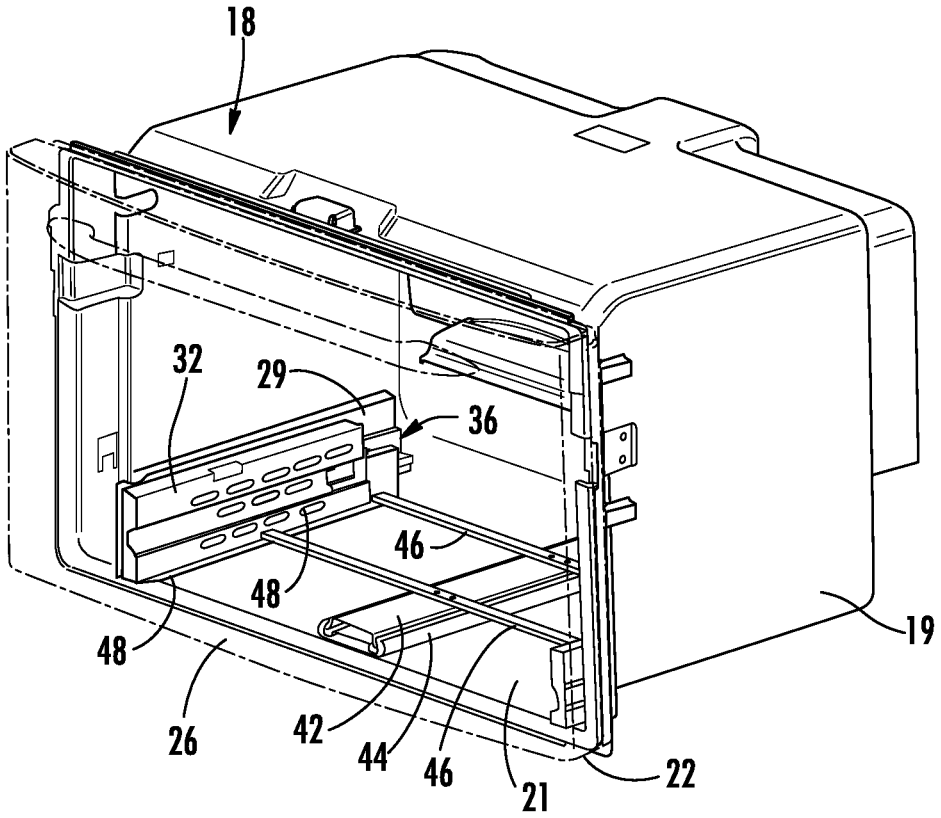
FIG. 3B is a partial perspective view of the pull-out drawer of FIG. 3A in a pulled-out state.

As particularly depicted in FIGS. 3A and 3B, the cross bars 46 are also rigidly fixed to the slide member 42 of the bottom slide assembly 40. It should thus be appreciated that, when the pull-out drawer 22 is pulled from the freezer compartment 18, the bottom slide assembly 40 restricts lateral deflection of the drawer 22, thereby resulting in automatic sequencing of the side slide assemblies 28. This unique configuration provides for better door alignment and sealing of the front panel 26 against the freezer compartment casing 12, as well as provides for a more stable feel of the drawer to the consumer. Wobbling or other type of motion that would otherwise be caused by lateral deflection and racking of the drawer 22 are eliminated. The bottom side assembly 40 may also support part of the load of the drawer 22, and thus increases the overall life of the side slide assemblies 28.

In the illustrated embodiment, the side slide assemblies 28 are mounted on the opposite side walls 19 of the compartment 18 proximate to the bottom wall 21. With this configuration, the slide brackets 32 for the side slide assemblies 28 also serve as a convenient mounting location for the cross bars 46, as discussed above. However, in an alternate embodiment, the side slide assemblies 28 may be mounted on the side walls 19 closer to the top of the bin/basket 23, with the cross bars 46 connected to the slide brackets 32 by any suitable linkage arrangement.

Figure 4:
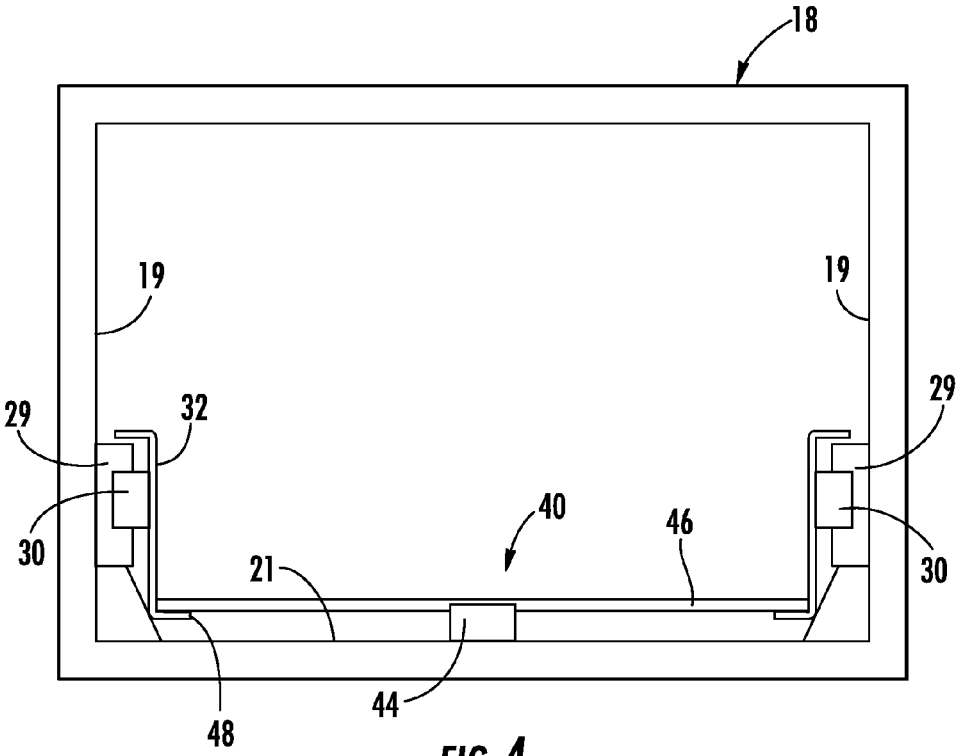
FIG. 4 is a front view of the freezer compartment and bottom slide assembly.
Figure 5:
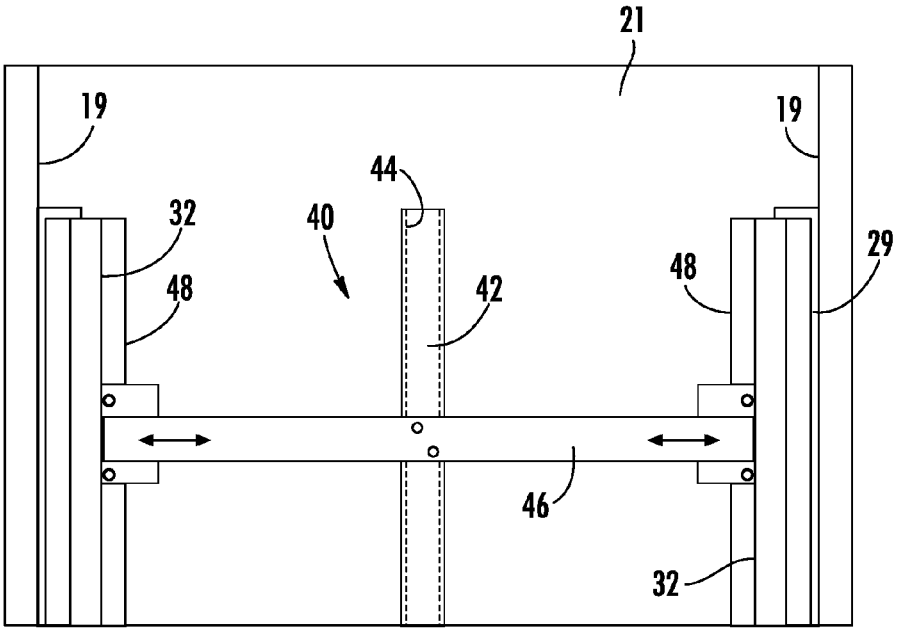
FIG. 5 is a top view of the freezer compartment and bottom slide assembly.

It should be appreciated that any number and configuration of cross bars 46 may be utilized. For example, in the embodiment illustrated in FIGS. 3A and 3B, two cross bars 46 are illustrated as connected between the opposite slide brackets 32. In the embodiment of FIGS. 4 and 5, a single cross bar 46 is mounted between the slide brackets 38 and is connected to the slide member 42 by any suitable means.

The cross bars 46 may be rigidly fixed to the slide brackets 32 with any manner of mechanical fastener, adhesive compound, and the like. In a particular embodiment, it may be desired that the cross bars 46 are linearly adjustable relative to the slide brackets 32 (as indicated by the arrows in FIG. 5). This linear adjustability may be accomplished by the type of connection between the cross bar 46 and brackets 32, or the cross bars 46 may include telescoping sections that allow for increasing or decreasing the longitudinal length of the cross bars 46. This degree of linear adjustability may be desired to accommodate for any deviations or variations in the dimensions of the freezer compartment liner, or other mechanical tolerances.

While described and illustrated in the exemplary context of a refrigerator drawer, it should be appreciated that the drawer assemblies described herein are not necessarily limited to use in any particular type of refrigerator, and may also have utility in a wide variety of appliances or other products. All such uses are within the scope and spirit of the invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A consumer appliance, comprising:

a compartment having opposite sides and a bottom wall;

a pull-out drawer configured above said bottom wall of said compartment, said pull-out drawer having a front panel for sealing the compartment;

a slide assembly configured on each opposite side of said compartment, said slide assembly including a base mounted to said compartment, a slide member, and a telescoping member linearly moveable along said base of said slide assembly and configured to slidably support said slide member of said slide assembly along said base of said slide assembly;

said pull-out drawer having a slide bracket slidably mounted to each respective said slide member for movement of said pull-out drawer into and out of said compartment, said slide brackets attached at opposite sides of said front panel;

a bottom slide assembly having a slide member, and a base mounted on said bottom wall of said compartment, and a telescoping member moveable along said base of said bottom slide assembly and configured to slidably support said slide member of said bottom slide assembly along said base of said bottom slide assembly;

a cross bar connected to and spanning between said slide brackets below said pull-out drawer and said cross bar connected to said slide member of said bottom slide assembly; and an intermediate cross bar, said intermediate cross bar connected to and spanning between said telescoping members of said slide assembly, and said intermediate cross bar connected to said telescoping, member of said bottom slide assembly.

2. The consumer appliance as in claim 1, wherein said slide assemblies are mounted on opposite sidewalls of said compartment proximate to said bottom wall, said slide brackets comprising a flange portion that extends below said pull-out drawer, said cross bar connected to said flange portion.

3. The consumer appliance as in claim 2, wherein said pall-out drawer is supported by said cross bar and bottom slide assembly.

4. The consumer appliance as in claim 2, wherein said cross bar is linearly adjustable on said flange portions.

5. The consumer appliance as in claim 1, comprising a plurality of said cross bars connected to said slide brackets and said slide member of said bottom slide assembly.

6. The consumer appliance as in claim 1, wherein said consumer appliance is a refrigeration appliance, said pull-out drawer configured in a freezer compartment of said refrigerator appliance.

7. A refrigeration appliance, comprising:

a freezer compartment having side walls and a bottom wall; a pull-out drawer configured in said freezer compartment, said pull-out drawer further comprising a front panel for scaling the freezer compartment;

a slide member configured (in each opposite side of said freezer compartment, said pull-out drawer having a slide bracket slidably mounted to each respective said slide member for movement of said pull-out drawer into and out of said freezer compartment, said slide brackets attached at opposite sides of said front panel;

a bottom slide assembly baying a slide member, a base mounted on said bottom wall of said compartment, and a bottom telescoping member moveable along said base of said bottom slide assembly and configured to slidably support said slide member of said bottom slide assembly along said base of said bottom slide assembly;

a cross bar connected to and spanning between said slide brackets below said pull-out drawer, said cross bar connected to said slide member of said bottom slide assembly;

a side telescoping member configured on each opposite side of said freezer compartment, said side telescoping member slidably supporting said slide member For movement of said pull-out drawer into and out of said freezer compartment; and an intermediate cross bar, said intermediate cross bar connected to and spanning between said side telescoping members, and said intermediate cross bar connected to said bottom telescoping member.

8. The refrigeration appliance as in claim 7, further comprising a slide assembly mounted to each opposite side of said compartment, said slide members moveable linearly into and out of said slide assemblies, said slide assemblies mounted to said compartment side walls proximate to said bottom wall of said compartment.

9. The refrigeration appliance as in claim 8, wherein said slide brackets comprise a flange portion that extends below said pull-out drawer, said cross bar connected to said flange portion and said pull-out drawer supported by said cross bar and bottom slide assembly.

10. The refrigeration appliance as in claim 9, wherein said cross bar is linearly adjustable on said flange portions.

11. A consumer appliance, comprising:

a compartment having opposite side walls and a bottom wall;

an intermediate cross bar;

a slide assembly configured on each opposite side wall of said compartment, each of said slide assemblies comprising a base mounted to one of said side walls of said compartment; and a slide member linearly moveable along said base of said slide assembly;

a telescoping member moveable along said base and configured to slidably support said slide member along said base;

a pull-out drawer configured above said bottom wall of said compartment, said pull-out drawer comprising a front panel for sealing the compartment;

a storage bin defining a pair of opposite side walls; and a slide bracket fixed to each opposite side wall of said storage bin, each slide bracket slidably mounted to one of said slide members of said slide assemblies;

a cross bar positioned below said pull-out drawer and connected to and spanning between said slide brackets of said pull out drawer; and a bottom slide assembly comprising a base mounted on said bottom wall of said compartment; and a slide member linearly moveable along said base of said bottom slide assembly and connected to said cross bar; and a telescoping member moveable along said base of said bottom slide assembly and configured to slidably support said slide member of said bottom slide assembly along said base of said bottom slide assembly; and wherein:

said intermediate cross bar is connected to and spanning between said telescoping members of said slide assembly, and said intermediate cross bar is connected to said telescoping member of said bottom slide assembly.

12. A consumer appliance as in claim 11, wherein said base of said bottom slide assembly is mounted on said bottom wall of said compartment approximately halfway between said pair of side walls of said compartment.

13. A consumer appliance as in claim 11, wherein said slide brackets comprise a flange portion that extends below said pull-out drawer, said cross bar connected to said flange portion.

14. A consumer appliance as in claim 11, wherein said pull-out drawer is supported by said cross bar and bottom slide assembly.

15. A consumer appliance as in claim 11, wherein said slide brackets comprise a flange portion that extends below said pull-out drawer, said cross bar connected to said flange portion, and wherein said cross bar is linearly adjustable on said flange portions.

16. A consumer appliance as in claim 11, Further comprising a plurality of said cross bars connected to said slide brackets and said slide member of said bottom slide assembly.

17. A consumer appliance as in claim 11, wherein said slide assemblies are configured on each side wall of said compartment proximate to said bottom wall.

* * * * *